United States Patent [19]

Weststrate et al.

[11] 4,317,291

[45] Mar. 2, 1982

[54] ROTATABLE DRUM DRIVE

[75] Inventors: Marinus H. Weststrate; Jan Willemsen, both of Lisse, Netherlands

[73] Assignee: Expert N.V., Curacao, Netherlands Antilles

[21] Appl. No.: 90,999

[22] Filed: Nov. 5, 1979

Related U.S. Application Data

[63] Continuation of Ser. No. 766,550, Feb. 7, 1977, abandoned.

[30] Foreign Application Priority Data

| | | | |
|---|---|---|---|
| Feb. 19, 1976 | [NL] | Netherlands | 7601719 |
| Oct. 19, 1976 | [NL] | Netherlands | 7611558 |
| Oct. 19, 1976 | [NL] | Netherlands | 7611560 |

[51] Int. Cl.[3] ..... F27B 7/26

[52] U.S. Cl. ..... 34/103; 432/103; 432/118; 51/164.1; 474/237

[58] Field of Search ..... 74/506, 203, 221; 51/164; 432/103, 118; 34/103, 118, 111, 121, 124, 128; 366/233

[56] References Cited

U.S. PATENT DOCUMENTS

| | | | |
|---|---|---|---|
| 1,698,454 | 1/1929 | Schaaf | 110/246 |
| 2,503,686 | 4/1950 | Raypholtz | 432/118 |
| 2,518,143 | 8/1950 | Huszar | 51/164 |
| 2,552,855 | 5/1951 | Johnston | 74/221 |
| 3,216,666 | 11/1965 | Svensson et al. | 51/164 |
| 3,386,718 | 6/1968 | Abbott | 432/103 |
| 3,401,924 | 9/1968 | Hurst | 432/103 |
| 3,521,866 | 7/1970 | Knappstein et al. | 432/103 |
| 3,669,433 | 6/1972 | Hurst | 432/103 |
| 3,822,485 | 7/1974 | Bates | 34/121 |
| 3,823,512 | 7/1974 | Kobayashi | 51/164 |
| 3,892,140 | 7/1975 | Fox et al. | 74/221 |
| 3,998,262 | 12/1976 | Didion | 51/164 |
| 4,030,878 | 6/1977 | Kunath | 432/103 |
| 4,071,961 | 2/1978 | Dietzel et al. | 432/103 |

*Primary Examiner*—Henry C. Yuen

*Attorney, Agent, or Firm*—Snyder, Brown & Ramik

[57] ABSTRACT

A device for treating solid and/or liquid materials comprises a drum driven for rotation about a horizontal axis by means of an endless chain.

An expensive toothed rim surrounding the drum is avoided, as it is possible that the chain engages a toothless portion of the drum periphery.

11 Claims, 20 Drawing Figures

FIG.1
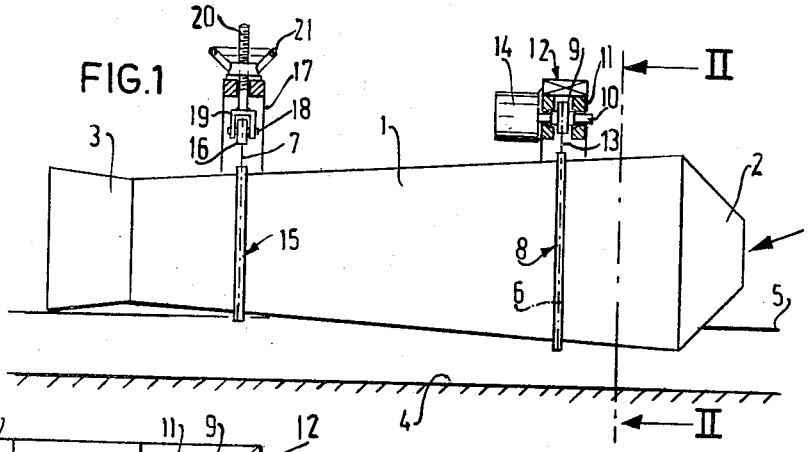
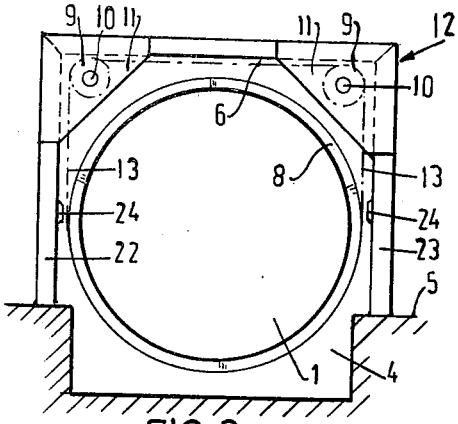
FIG.2
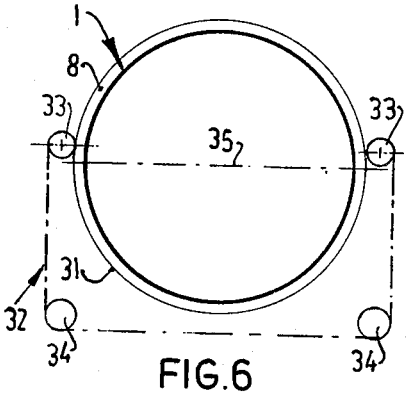
FIG.6
FIG.5
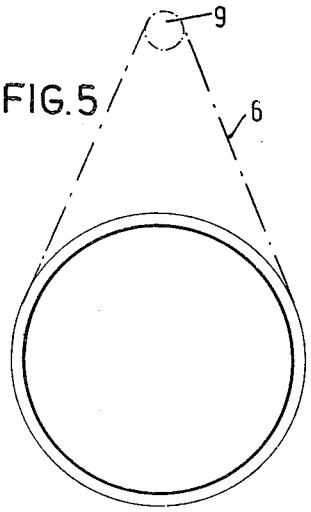
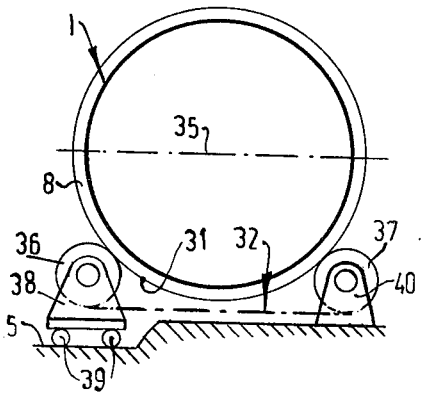
FIG.7

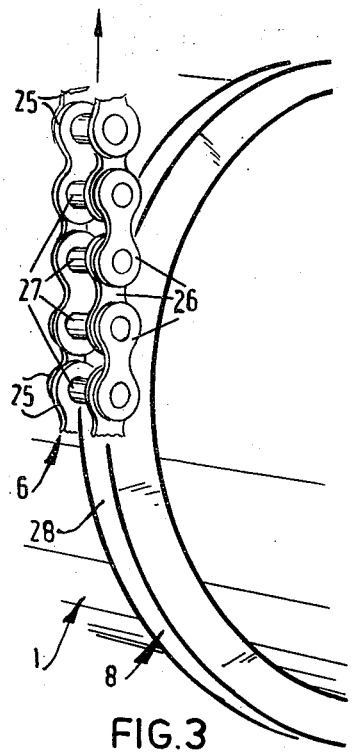
FIG.3
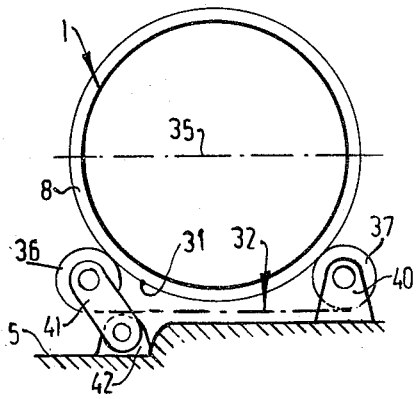
FIG. 4
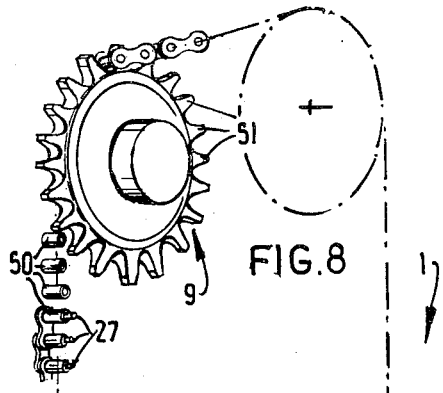
FIG.8
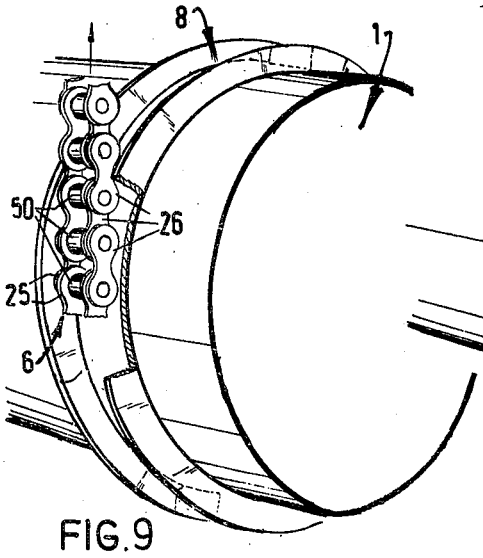
FIG.9
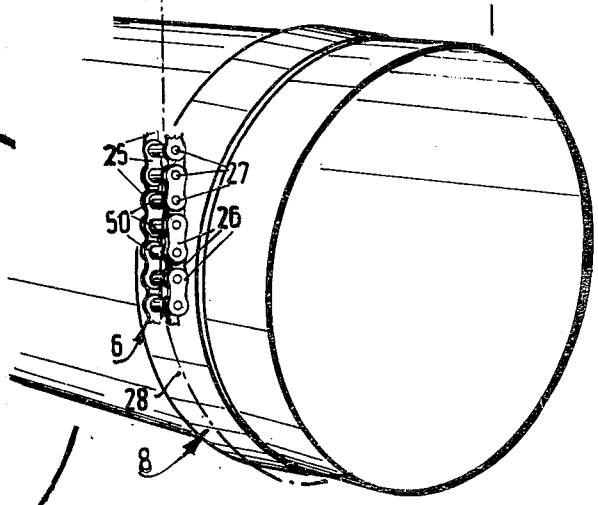

FIG.10
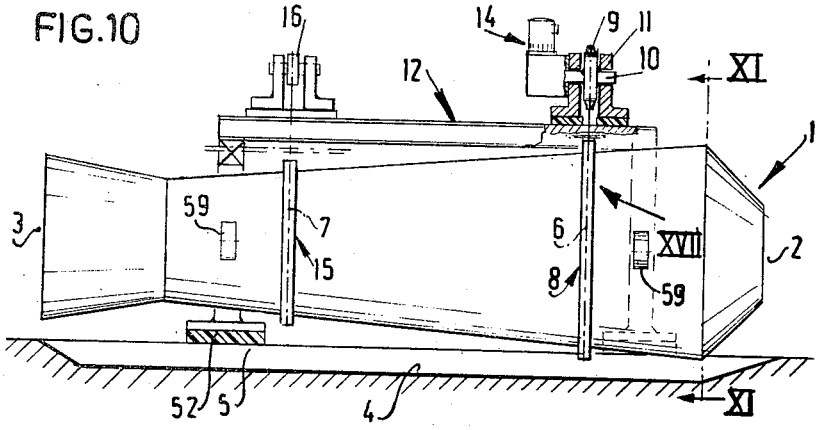
FIG.11
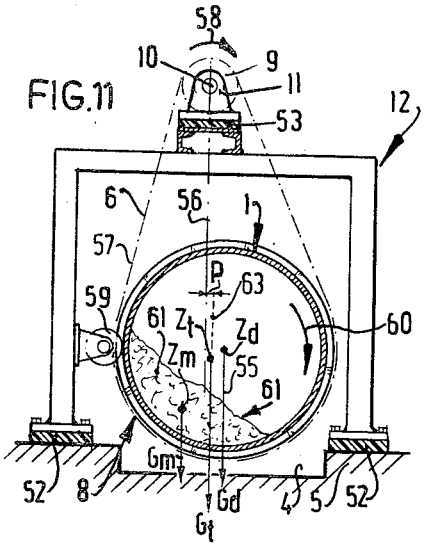
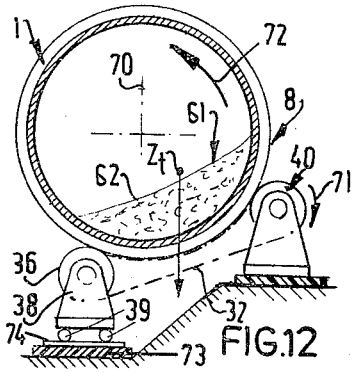
FIG.12
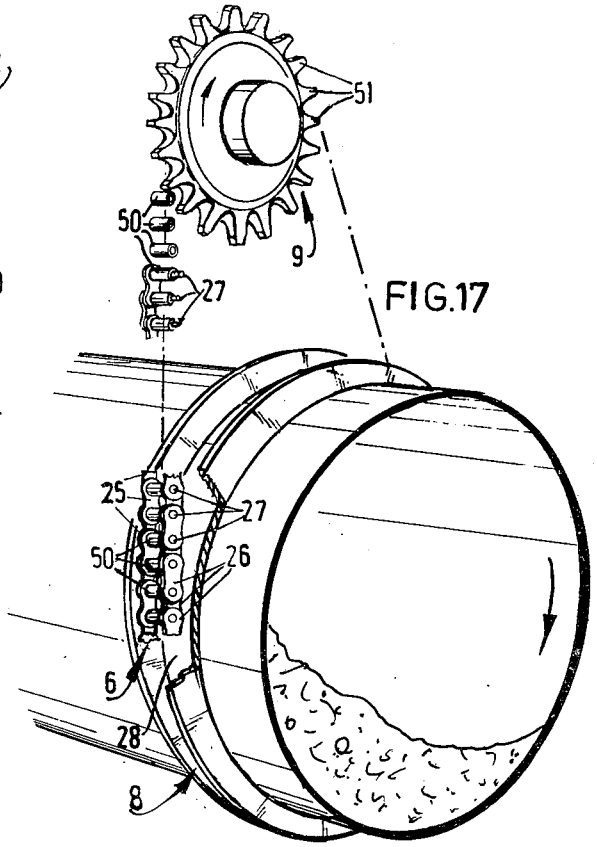
FIG.17

FIG. 13
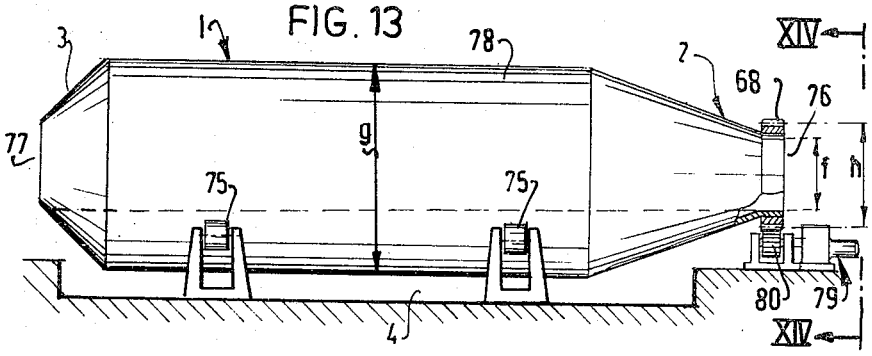
FIG.15
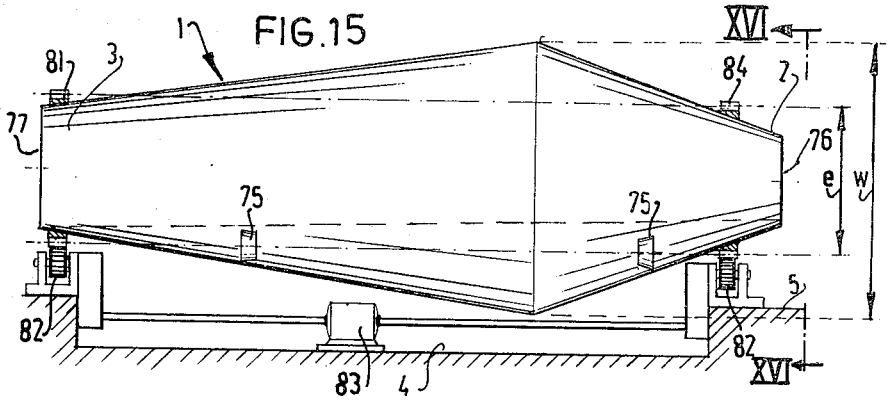
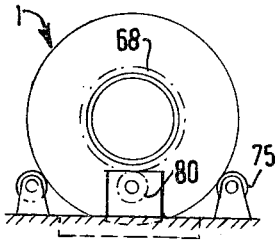
FIG.14
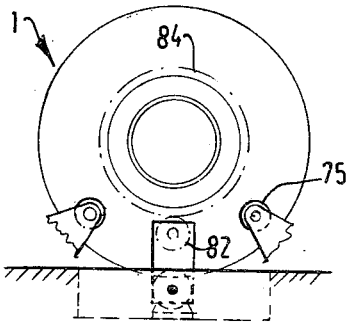
FIG.16

FIG.18
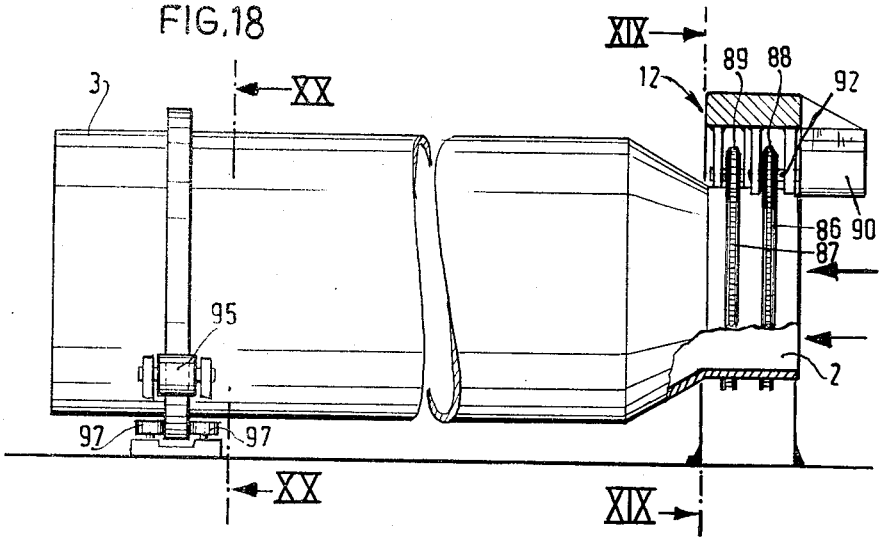
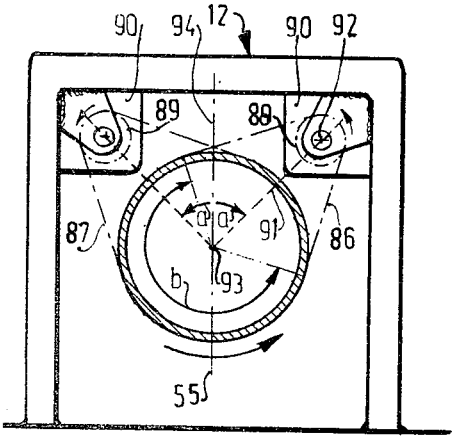
FIG.19
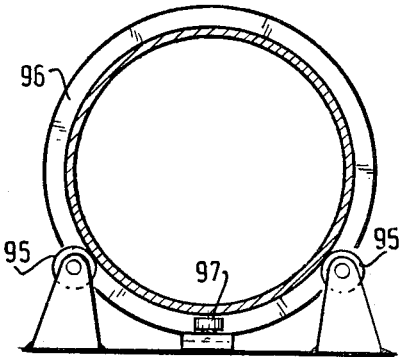
FIG.20

ROTATABLE DRUM DRIVE

This is a continuation of application Ser. No. 766,550 filed Feb. 7, 1977, now abandoned.

The invention relates to a device for treating solid and/or liquid materials, particularly for cooling and drying mould sand and for cooling castings, said device comprising a horizontal, rotatably driven drum, the object of the invention being an improvement of the disposition and the drive of said drum.

In numerous industries horizontal, rotatable drums are employed for cooling, drying, mixing, sorting and the like solid and/or liquid materials.

In the case of a horizontal disposition the drums are usually supported by pairs of rotatable rollers, whilst the drums are generally rotated by means of one or more driven chain wheels engaging a toothed rim along the circumference of the drum.

There is furthermore known a drum for cooling and drying castings and mould sand, which is suspended in a horizontal position to two chains, each of which passes along a toothed rim at the circumference of the drum and around a chain sprocket disposed at a level above the drum, the two chain sprockets being fastened to a common, horizontal shaft driven by a motor.

Although the disposition and the rotatable drive described above are, in general, satisfying, the use of toothed rims at the drum circumference, which toothed rims have to be accurately machined, is fairly expensive. Consequently, there is a need for a simpler method of disposition and driving.

The invention has for its object to satisfy this need. It is based on a device comprising a horizontally disposed, rotatably driven drum, which is supported by at least one endless chain travelling along the drum circumference and around at least one actuated driving element and is characterized in that the chain engages a tooth-free portion of the drum circumference. This tooth-free portion may be a single, smooth collar on the drum circumference or a double collar or a collar having a central groove, but as a further alternative the collar may be completely dispensed with, in which case the chain is caused to directly engage the drum wall.

It has been found that in this way despite the absence of a toothed rim on the drum circumference a satisfactory disposition and a drive of the drum are obtained. The simple fact that the drum bears with its weight on the chain is sufficient for stretching the chain so that a non-slipping contact between the chain and the drum wall or the collar is ensured, which provides an effective suspension and drive. By omitting the toothed rims the solution is considerably less expensive.

Within the scope of the invention various embodiments can be designed. In a preferred design the drum is suspended to at least one endless chain, which passes around a toothless portion of the drum circumference and around at least one actuated driving element mounted above the drum in a stationary frame. The weight of the drum ensures a slip-free drive. In a further embodiment the drum bears on the upper run of at least one endless chain, which passes around a toothless portion of the drum circumference and around two actuated driving elements arranged at the same level at the side of the drum circumference at places above the horizontal median plane of the drum and also around at least one driving element arranged beneath the drum. The weight of the drum stretches the upper run of the chain so that also in this case a slip-free contact is obtained.

In a third embodiment the drum bears on the upper run of at least one endless chain, which passes around a toothless portion of the drum circumference and around two actuated driving elements arranged at the same level at the side of the drum circumference at places lying beneath the horizontal median plane of the drum, one of said driving elements being mounted on a mobile or pivotable frame. In this case the weight of the drum urges the mobile or pivotable frame part aside until the upper run of the chain is taut and a slip-free contact for the drive is ensured.

The invention will be described more fully with reference to a drawing.

In the drawing:

FIGS. 1, 10, 13, 15 and 18 each show schematically an elevational view of a different device embodying the invention, FIG. 2 is an elevational view taken in the direction of the arrow II in FIG. 1, FIG. 3 shows a detail of the device of FIGS. 1 and 2 on an enlarged scale, FIG. 8 and 9 each show a variant of the device of FIG. 3, FIGS. 4 to 7 are elevational views corresponding to FIG. 2 of four further devices embodying the invention, FIG. 11 is a cross-sectional view taken on the line XI—XI in FIG. 10, FIG. 12 is a cross-sectional view of a further device embodying the invention, FIG. 14 is an elevational view taken in the direction of the arrows XIV in FIG. 13, FIG. 16 is an elevational view taken in the direction of the arrows XVI in FIG. 15, FIG. 17 is a perspective view, partly broken away, of the detail XVII in FIG. 10, FIG. 19 is a cross-sectional view taken on the line XIX—XIX of FIG. 18 and FIG. 20 is a cross-sectional view taken on the line XX—XX in FIG. 18.

Each device according to the invention to be described hereinafter comprises an elongated, slightly conical drum 1 having an inlet end 2 and an outlet end 3. This drum 1 may serve for cooling, drying, mixing, sorting or a different treatment of solid and/or liquid materials, but particularly for cooling and drying mould sand and for cooling castings. With regard to the specific use additional arrangements may be made, for example, perforations of the wall, internal burners, internal sprays, internal guide blades, air suction means and the like, but since the invention mainly relates to the mode of suspension and the drive of the drum, such additional steps are not shown herein.

The drum 1 is located above a depression 4 of a foundation 5 and is supported in a horizontal position by two endless chains 6, 7, which serve both for suspending and for rotating the drum. The chain 6 passes around a collar 8 at the circumference of the drum and furthermore along one or two chain sprockets 9, each of which is freely rotatably by a shaft 10 in bearings 11. The bearings 11 may be formed by side plates of a yoke-shaped frame 12 standing on the foundation 5 (FIG. 2). The chain sprockets 9 are disposed at the same height above the drum 1 and spaced apart by a distance such that the pending portions 13 of the chain 6 extend in a substantially vertical direction. Each of the chain sprockets 9 is driven by a motor 14.

The chain 7 (FIG. 1) passes in a similar manner around a collar 15 at the circumference of the drum 1 and furthermore along two rollers 16, which are fastened to a yoke-shaped frame 17 bearing on the foundation 5, so that the rollers 16 are freely rotatable. The rollers 16 are located at the same level above the drum 1 and are spaced apart by a distance such that the pending portions of the chain 7 are substantially vertical. The height of the rollers 16 is adjustable, since they are each suspended by a shaft 18 in a chain stretcher formed by a claw 19 at the lower end of a vertical screw spindle 20 passing through the frame 17 and being movable up and down by means of a hand-wheel 21.

The limbs 22 and 23 of the yokes 12 and 17 are provided with buffer cushions 24 (FIG. 2) in order to avoid any impacts of the drum 1 on the yoke.

In operation the drum 1 occupies the position shown in FIG. 1. It is rotated by starting the motors 14, which drive the chain sprockets 9 and hence the chain 6. The chain 7 is not driven directly, but moves with the rotation of the drum 1. Each of the two chains 6, 7 engages a collar 8, 15 of the drum 1 and remains in a slip-free contact with said collar, since the weight of the drum 1 bears on the chains 6, 7. If the chains 6, 7 elongate, the position of the drum 1 can be readjusted by elevating the rollers 16 by means of chain stretchers.

FIG. 3 illustrates the co-operation between the chain 6 and the collar 8 at the drum circumference (this also applies to the chain 7 and the collar 15). By this co-operation the links 25, 26 of the chain 6 will lie on both sides of the collar 8 so that sliding aside cannot occur. The pins 27 of the chain exert pressure on the race 28 of the collar 8 and since the weight of the drum 1 bears on the chain, the resultant friction will be such that the pins 27 will not slide along the race 28. The final result is a slip-free contact, which is sufficient to cause the drum 1 to rotate. The collar does not require teeth and need not be accurately machined. As the case may be, the collar 8 may even be noncircular, provided the race 28, viewed in a direction parallel to the axis of the drum, remains substantially flat. It is, however, a condition of a satisfactory operation that in operation the collar 8 should occupy a vertical position during operation in order to avoid oblique engagement or torsion of the chain. This vertical position of the collar 8 (and of the collar 15) can be maintained by regular readjustment of the rollers 16 by means of the chain stretchers.

FIGS. 4 to 7 illustrate schematically a number of variants of the arrangement of FIG. 2. The arrangement of FIG. 5 differs from that shown in FIG. 2 only in that the chain 6 passes on the top side along one chain wheel or roller 9 rather than along two chain wheels 9. This single chain wheel 9 is again driven by a motor 14. The operation of this embodiment is similar to that of FIG. 2, but the effect is slightly less favourable because the weight of the drum 1 is hanging by the chain 6 on a single chain wheel 9, whilst the driving force has to be supplied by a single motor 14, which will thus be more expensive.

In the arrangement shown in FIG. 6 the drum 1 bears on the upper run 31 of an endless chain 32, which is passed along four toothed wheels (or rollers) 33, 34. Two of these toothed wheels 33 are located at the same level at the side of the circumference of the drum 1 at an area located slightly above the horizontal median plane 35 of the drum 1, whereas the two further toothed wheels 34 are located substantially perpendicularly beneath the wheels 33. The wheels 33 are each driven by a motor (not shown). The arrangement shown ensures a slip-free contact, since owing to the weight of the drum 1 the upper run 31 of the chain 32 will be taut and satisfactory engage the collar 8 of the drum 1.

FIG. 7 shows the drum 1 bearing also on the upper run 31 of an endless chain 32. The chain 32 passes furthermore along two toothed wheels (or rollers) 36, 37, located at the same level at the side of the drum circumference at a place located beneath the horizontal median plane 35. One of the toothed wheels 36 is rotatably mounted in a chair 38, which is mobile by rollers 39 along the foundation 5. The other toothed wheel 37 is rotatably mounted in a stationary chair 40. The two toothed wheels 36 and 37 can be driven by a motor (not shown). In operation the drum 1 bears on the upper run 31 of the chain 32 so that the chair 38 will be urged outwardly to an extent such that the upper run of the chain 32 will be taut. Then a satisfactory, slip-free contact is ensured owing to the friction between the chain 6 and the collar 8.

The arrangement shown in FIG. 4 differs from that shown in FIG. 7 in that the toothed wheel 36 is not mounted on a mobile chair 38 but is rotatably mounted at one end of a pivotal arm 41, the other end of which is pivoted to a stationary support 42 on the foundation 5. Also in this case the toothed wheel 36 will be urged outwardly by the weight of the drum 1 so that the upper run of the chain is taut and a satisfactory, slip-free contact is obtained.

FIG. 8 shows how the chain 6 is adapted to co-operate with a collar 8 formed by a toothless steel tape welded to the drum 1 (the same applies to the chain 7 and the collar 15). By this co-operation the links 25, 26 of the chain 6 comes into contact with the toothless race 28 of the collar 8 and since the weight of the drum 1 bears on the chain 6 the resultant friction will be such that the links 25, 26 cannot slide along the race 28. The final result is a slip-free contact, which is sufficient to cause the drum 1 to rotate. The collar 8 need not have teeth and it need not be machined with particular precision. As the case may be, the collar 8 may even be noncircular provided, viewed in a direction parallel to the axis of the drum, the race 28 remains substantially flat. It is, however, a condition of a satisfactory operation that the collar 8 should occupy a substantially vertical position in operation a slanting engagement of torsion of the chain. This vertical position of the collar 8 (and of the collar 15) can be maintained by repeated readjustment of the rollers 16 by means of the chain stretchers. Since the chain 6 is a single chain, that is to say, built up from a series of pins 27, only the ends of which are interconnected by links 25, 26, an accurately vertical position of the chain 6 is not required, which allows from some inaccuracy in mounting the bearings of the chain sprockets 9 and 16 of the collars 8 and 15. The chains 6 and 7, having in each run an admissible tensile force of, for example, 60,000 to 140,000 kgs, carry in each run with a sixfold safety a weight of about 10,000 to 23,000 kgs of the filled drum 1 and may yet be single chains. The links 25, 26 are preferably formed by S-shaped forged plates.

The pins 27 have freely rotatable rollers 50 gripping in between 19 or more teeth 51 of the chains sprockets 9 so that wear of the pins 27 is avoided.

The collars 8 and 15 may each be formed by a toothless, channel-section gutter fastened to the periphery of the drum (see FIG. 9) rather than by a flat tape.

FIGS. 10, 11 and 12 show that the bearings 11 are supported through an elastic cushion 53 of rubber or rubber cushions 52 by a yoke-shaped frame 12 on the foundation 5. The chain 7 passes in a similar manner around a second collar 15 at the periphery of the drum 1 and furthermore along a chain sprocket 16, which is freely rotatable in bearings 11 bearing on an elastic cushion 53 of a yoke-shaped frame 12 supported through elastic cushions 52 by the foundation 5. The chains 6, 7 engage the drum 1 asymmetrically (FIG. 11). For this purpose the bearings 11 are located above the drum 1 in a vertical longitudinal plane 56 outside the vertical central, longitudinal plane 55, where the centre of gravity Zd of the drum is located, that is to say, on that side of the central longitudinal plane 55 where the drawn run 57 of the chain 6 is located when the chain sprocket 9 is driven by a motor 14 in the direction of the arrow 58. The drum 1 is laterally retained by rollers 59 journalled on the frames 12. Owing to the rotation of the drum 1 in the direction of the arrow 60, the material 61 to be treated assumes the sloping position 62 so that the centre of gravity Zm of the material is located outside the central, longitudinal plane 55. The disposition of each chain sprocket 9 is preferably such that they are located at a small distance p from the plane 63 going through the centre of gravity Zt of the rotating drum 1 filled with material 61. Therefore, the drum 1 constantly exerts a slight lateral force on the rollers 59 so that swinging of the drum 1 is avoided. By using the elastic cushions 53 and 52 the upward and downward jumps of the drum 1 due to the suspensions to chains are resiliently absorbed. The chain 7 is not directly driven, but it moves together with the rotation of the drum 1. Each of the two chains 6, 7 engages a collar 8 of the drum 1 and remains in a slip-free contact with said collar, since the weight of the drum 1 is carried by the links 25, 26 of the chains 6, 7.

From FIG. 17 it is apparent how the chain 6 co-operates with a collar 8 at the periphery of the drum formed by a toothless steel U-profile welded to the drum 1 (the same applies to the chain 7). Owing to this co-operation the links 25, 26 of the chain 6 come into contact with the toothless race 28 of the collar 8 and since the weight of the drum 1 bears on the chain 6 the resultant frictional force will be such that a slipping motion of the links 25, 26 along the race 28 is not possible. As a result a slip-free contact is obtained, which is sufficient for the drum 1 to rotate. The collar 8 need not be provided with teeth and it need not be machined with particular precision. In certain cases the collar 8 may even be non-circular, provided the race 28, viewed in a direction parallel to the axis of the drum, remains substantially flat. Since the chain 6 is a single chain, that is to say, built up from a series of pins 27, only the ends of which are interconnected by links 25, 26, an accurately vertical position of the chain 6 is not required, which allows for mounting inaccuracies of the bearings of the chain sprockets 9 and of the collars 8. The chains 6, 7 having in each run an admissible tensile force of, for example, 60,000 to 140,000 kgs, carry in each run, with a sixfold safety margin, a weight of about 10,000 to 23,000 kgs of the filled drum 1 and may nevertheless be simple chains. The links 25 and 26 are preferably formed by S-shaped forged plates. The pins 27 hold freely rotatable rollers 50, which grip in between 19 or more teeth 51 of the chain sprockets 9 so that wear of the pins 27 is avoided.

The drum 1 of FIG. 12 bears on a chain 32, which passes along an actuated driving element 40 and along a reversing roller 36, which are located one on each side of the central, longitudinal plane 70 of the drum 1 beneath the drum 1. The driving element 40 is further spaced apart from the central, longitudinal plane 70 and is located at a slightly higher level than the reversing roller 36 so that with a minimum length of the chain 32 a stable bearing for the drum 1 is obtained. With the direction of drive 71 of the driving element 40 and with the direction of rotation 72 of the drum 1, the material 61 assumes the slope 62 so that the centre of gravity Zt of the filled, rotating drum 1 is substantially located midway between the driving element 40 and the reversing roller 36. The driving element 40 bears via a rubber cushion 73 on the foundation 5. The reversing roller 36 is journalled in a displaceable bearing 38, which is supported via rollers 39, a plate 74 and an elastic cushion 73 by the foundation 5.

The device shown in FIGS. 13 and 14 comprises a horizontally disposed drum rotatably journalled on rollers 75, the sheath 78 of said drum having a large diameter g of, for example, 2 to 3 meters. The drum 1, intended for treating solid and/or liquid materials, has at one end a circular inlet port 76 and at the other end a delivery port 77. The inlet port 76 has a diameter f of, for example, 1 meter, hence materially smaller than the diameter g. According to the invention the circular, central inlet port 76 is surrounded by a toothed rim 68, which may thus have a comparatively small diameter h. A driving element actuated by a motor 79 and being formed by a toothed wheel 80 engages the toothed rim 68. In this way a large, expensive toothed rim is avoided, which would be required if the drum 1 were driven with the aid of a toothed rim surrounding the sheath 78. If the toothed rim 68 co-operates with a chain, an advantageous, short chain will suffise.

The device shown in FIGS. 15 and 16 for treating solid and/or liquid materials comprises a horizontally arranged drum 1 journalled on rollers 75 and having at its circumference two toothed rims 84 and 81, which have substantially equal diameters e. The diameter e is appreciably smaller than the largest diameter w of the drum sheath 78, whose passage diminishes from the central portion towards the delivery port 77. One toothed rim 84 is arranged near the inlet port 76 and the other toothed rim 81 is located near the delivery port 77 of the drum periphery. This device has the advantage that owing to the identical shape and the comparatively small diameter the toothed rims 84 and 81 can be manufactured at a reasonable price, whilst the drive of the drum 1 with the aid of the two toothed wheels 82 actuated by a common motor 83 prevents with certainty a slanting run of the drum 1.

The inlet end 2 of the drum 1 of FIGS. 18 to 20 bears on two chains 86 and 87 passed along two rotors formed by chain sprockets 88 and 89 respectively. The chain sprockets 88 and 89 are each driven by an individual electric motor 90. The chain sprockets 88 and 89 are located each on one side of the central, longitudinal plane of the drum 1 and above the same and rotatably journalled on a frame 12. The chains 86 and 87, engaging each the drum 1 asymmetrically in the manner shown for the chains 6 and 7 of FIG. 1, carry the drum 1 in a stable manner between the chain sprockets 88 and 89. The plane 91 going through the rotary axis 92 of the chain sprockets 88 and 89 and the rotary axis 93 of the drum 1 is preferably at an angle a of about 45° to the vertical 94.

Since the arc subtended by each chain 86 and 87 and designated by b on the drum 1 is large, each chain is capable of driving the drum 1 with a large power.

The outlet end 3 of the drum 1 may be held in the same manner as the inlet end 2, but as an alternative it may be held by means of rollers 95 engaging a ring 96 of the drum 1, said ring 96 being conducted between guide rollers 97.

What we claim is:

1. A device for treating solid and/or liquid materials, particularly for cooling and drying mold sand and for cooling castings, which comprises in combination:

a substantially horizontal drum adapted to receive material to be treated, a plurality of collars disposed in longitudinally spaced relation on said drum, each collar having a smooth, flat and toothless cylindrical surface and said collars being disposed in parallel, coaxial relation to each other;

means engaging said collars for supporting the entire weight of said drum and the contents thereof, said means comprising a frame, at least one drive sprocket mounted for rotation on said frame about a horizontal axis and an endless chain passing over said drive sprocket and having a depending bight portion engaging a portion of the cylindrical surface of one of said collars in slip-free contact therewith to suspend a corresponding portion of the weight of said drum and contents thereof, said drive sprocket being positioned such that said collars are disposed in parallel, vertical planes and said one collar is disposed in a vertical plane also containing said drive sprocket; and drive means for rotating said drive sprocket correspondingly to rotate said drum through the slip-free contact between said chain and said one collar.

2. A device as defined in claim 1 including at least one roller and a second endless chain passing over said roller and having a depending bight portion engaging a portion of the cylindrical surface of a second one of said collars in slip-free contact therewith to suspend a further portion of the weight of said drum and contents thereof.

3. A device as defined in claim 1 including a second sprocket on said frame and over which said chain is passed, both of said sprockets being disposed above said drum.

4. A device as defined in claim 2 including a second sprocket on said frame and over which said chain is passed, both of said sprockets being disposed above said drum.

5. A device as defined in claim 4 including a second roller over which said second chain is passed, said rollers being disposed above said drum.

6. A device as defined in claim 2 wherein both said drive sprocket and said roller are disposed above said drum and including means for adjusting the vertical position of said roller to maintain said collars in said vertical planes.

7. A device as defined in claim 1 including a pair of support rollers disposed below the axis of the drum and engaging the cylindrical surface of another of said collars.

8. A device as defined in claim 7 including a second drive sprocket rotatably mounted on said frame and a second chain passing over said second drive sprocket and having a depending bight portion in which a second collar is seated in slip-free engagement, said one collar and said second being disposed in closely spaced relation and said drive sprockets being laterally offset from each other.

9. A device as defined in claim 1 including cushion means mounting said drive sprocket on said frame.

10. A device as defined in claim 1 wherein said chain engages said one collar assymmetrically with respect to a vertical plane passing through the axis of said drum.

11. A device as defined in claim 1 including at least one elastic cushion through which said drum bears on a foundation.

* * * * *